US006382594B1

(12) United States Patent
Ransom

(10) Patent No.: US 6,382,594 B1
(45) Date of Patent: May 7, 2002

(54) POST PULLER

(75) Inventor: Desmond L. Ransom, Dillsboro, IN (US)

(73) Assignee: Ammbusher, Inc., Aurora, IN (US)

( * ) Notice: Subject to any disclaimer, the term of this patent is extended or adjusted under 35 U.S.C. 154(b) by 0 days.

(21) Appl. No.: 09/628,595

(22) Filed: Jul. 28, 2000

Related U.S. Application Data

(60) Provisional application No. 60/146,529, filed on Jul. 30, 1999.

(51) Int. Cl.[7] ..... E21B 19/00
(52) U.S. Cl. ..... 254/30
(58) Field of Search ..... 254/30, 132, 29 R, 254/31

(56) References Cited

U.S. PATENT DOCUMENTS

| | | | |
|---|---|---|---|
| 1,452,205 | A | 4/1923 | Madsen |
| 2,124,154 | A | 7/1938 | Sovincz |
| 2,482,950 | A | 9/1949 | Toftey |
| 3,647,185 | A | 3/1972 | Phibbs |
| 3,823,916 | A | 7/1974 | Shaw |
| 3,848,850 | A | 11/1974 | Bemis |
| 3,871,618 | A | 3/1975 | Funk |
| 4,256,286 | A | 3/1981 | Hudgins |
| 4,706,935 | A | 11/1987 | Thompson |
| 4,822,006 | A | 4/1989 | McIntire |
| 4,846,445 | A | 7/1989 | Pfeffer |
| 5,211,374 | A | 5/1993 | Head et al. |
| 5,242,152 | A | 9/1993 | Schatz |
| 6,056,271 | A | 5/2000 | Riojas |

*Primary Examiner*—Robert C. Watson
(74) *Attorney, Agent, or Firm*—Frost Brown Todd LLC

(57) ABSTRACT

The improved hydraulically operated post pulling apparatus is adapted to be mounted on a vehicle such as a skid steer mover. The post puller apparatus includes a support frame adapted to be mounted on the vehicle. The support frame includes a number of base member brackets that attach a base member or base plate to the support frame. The base member includes a post receiving recess that is adapted to receive a post from the side rather than the top. The post pulling apparatus also includes a top support plate that includes a post receiving indent, which also is adapted to receive a post from the side rather than the top. A rotating jaw member having a member of post-engaging teeth is pivotally mounted next to the post receiving indent on the top support plate. Opposite the rotating jaw member, a fixed jaw member is attached to the top support plate that includes a number of post-engaging faces. A clamping cylinder is mounted to the top support plate and includes a piston that is pivotally attached to the rotating jaw member. The piston, when extended, operates to pivot the rotating jaw member downwardly into engagement with the post to be engaged and removed from the ground. First and second pairs of bar links are each pivotally mounted at one end to the support frame and pivotally mounted at an opposite end to a forward panel that is preferably attached to the rear of the support plate. A pair of pulling hydraulic cylinders are mounted on the base member, each having a piston attached to the top support plate. When the pistons of the pulling hydraulic cylinders are extended, the bar link pivot allowing the top support plate to lift and raise the pole from the ground.

10 Claims, 4 Drawing Sheets

POST PULLER

The present application is based on and claims priority benefit of U.S. Provisional Patent Application Ser. No. 60/146,529, filed Jul. 30, 1999, the entire specification of which is incorporated herein by reference.

TECHNICAL FIELD

The present invention relates generally to post pullers and, more particularly, to an improved attachment for use with hydraulic power sources for pulling posts from the ground.

BACKGROUND OF THE INVENTION

The removal of highway guardrails and fence posts, especially those mounted in concrete, is a very difficult task. This task is frequently accomplished in a rather haphazard and unsafe manner. Generally, extracting a post may be accomplished by wrapping a chain around the post, then pulling up on the chain until it is tight and will "bind" on the post. This requires a minimum of two persons—one to wrap the chain and keep a "binding" force tension on the chain, and one to operate the machine to lift or pull the post from the ground. This is a dangerous operation because the person wrapping the chain onto the post must manually keep tension of the chain while the equipment operator pulls the chain tight, and often the operator cannot fully see the other person while operating the machine. Highway guardrails are pulled in a similar manner—either by wrapping the guardrail with a chain or attaching a cable to the guardrail with a plate clamp or similar device. Additionally, the second person or helper must also unchain or unclamp the post or guardrail in order to move on the next one.

In addition, apparatus for pulling posts out of the ground are known in the art. Some such apparatus are so designed that they must be transported by hand to the site where they are to be used. Other apparatus, although designed to be vehicle mounted, are not provided with sufficient positive extracting force to be used for posts of larger sizes or that are set relatively deeply in the ground. Still others which are designed to be motor vehicle mounted have a minimal radius of operation or, at best, are confined to operation within an extremely limited radius from the vehicle. Still other post puller designs are incapable of effective use for removing posts of various diameters or cross-sectional shapes.

The forces required to pull a post from the ground are often very large and indeterminate, due to unknowns such as soil compaction, soil type, suction, and other unknown variables. Therefore, many prior art post pulling machines are incapable of pulling a post from the ground, even if there were a method of clamping or gripping the post. The actual pulling or lifting function often requires the use of a large machine, due to the high breakout lifting forces required. These larger machines are required because they must supply all of the lifting or pulling force. These larger machines can also be a hazard when operating in the confined spaces of a heavily traveled highway.

OBJECTS OF THE INVENTION

Accordingly, it is an object of the present invention to provide post puller adapted to be mounted on a prime mover or vehicle with a hydraulic power source that addresses the disadvantages of the above-described prior art.

It is a further object of the present invention to provide a post puller attachment that grips the post from the side or front and that is adapted to clamp the object to be removed from the ground relatively low to the ground.

It is still a further object of the present invention to provide a post puller attachment wherein the initial lifting or breakout force is supplied by the attachment which reacts against the ground and, as a result, is adaptable for use with relatively smaller and more maneuverable handling machinery such as skid steer loaders or small tractors.

It is yet a further object of the present invention to provide a post puller attachment which is characterized by rugged construction and ease of use.

Still other objects of the present invention will become apparent to those skilled in this art from the following description and drawing wherein there is described and shown a preferred embodiment of the invention. As will be realized, the invention is capable of other different embodiments, and its several details are capable of modification in various, obvious aspects all without departing from the invention. Accordingly, the drawings and descriptions will be regarded as illustrative in nature and not as restrictive.

SUMMARY OF THE INVENTION

To achieve the foregoing and other objects, and in accordance with one aspect of the present invention, an improved post puller is provided. The improved hydraulically operated post pulling apparatus is adapted to be mounted on a vehicle such as a skid steer mover. The post puller apparatus includes a support frame adapted to be mounted on the vehicle. The support frame includes a number of base member brackets that attach a base member or base plate to the support frame. The base member includes a post receiving recess that is adapted to receive a post from the side rather than the top.

The post pulling apparatus also includes a top support plate that also includes a post receiving indent, which is also adapted to receive a post from the side rather than the top. A rotating jaw member that includes a plurality of post-engaging teeth is pivotally mounted next to the post receiving indent on the top support plate. Opposite the rotating jaw member and also next to the post receiving indent, a fixed jaw member is attached to the top support plate that includes a number of post-engaging faces. A clamping cylinder is mounted to the top support plate and includes a piston that is pivotally attached to the rotating jaw member. The piston, when extended, operates to pivot the rotating jaw member downwardly into engagement with the post to be engaged and removed from the ground. First and second pairs of bar links are each pivotally mounted at one end to the support frame and pivotally mounted at an opposite end to a forward panel that is preferably attached to the rear of the support plate. A pair of pulling hydraulic cylinders are mounted on the base member, each having a piston attached to the top support plate. When the pistons of the pulling hydraulic cylinders are extended, the bar links pivot allowing the top support plate to lift and raise the pole from the ground.

DESCRIPTION OF THE DRAWINGS

The accompanying drawings incorporated in and forming a part of the specification illustrates several aspects of the present invention, and together with the description and claims serves to explain the principles of the invention. In the accompanying drawings:

DETAILED DESCRIPTION OF THE INVENTION

Reference will now be made in detail to the present preferred embodiment of the invention, an example of which is illustrated in the accompanying drawings, wherein like numerals indicate corresponding elements throughout the figures.

Figure 1:
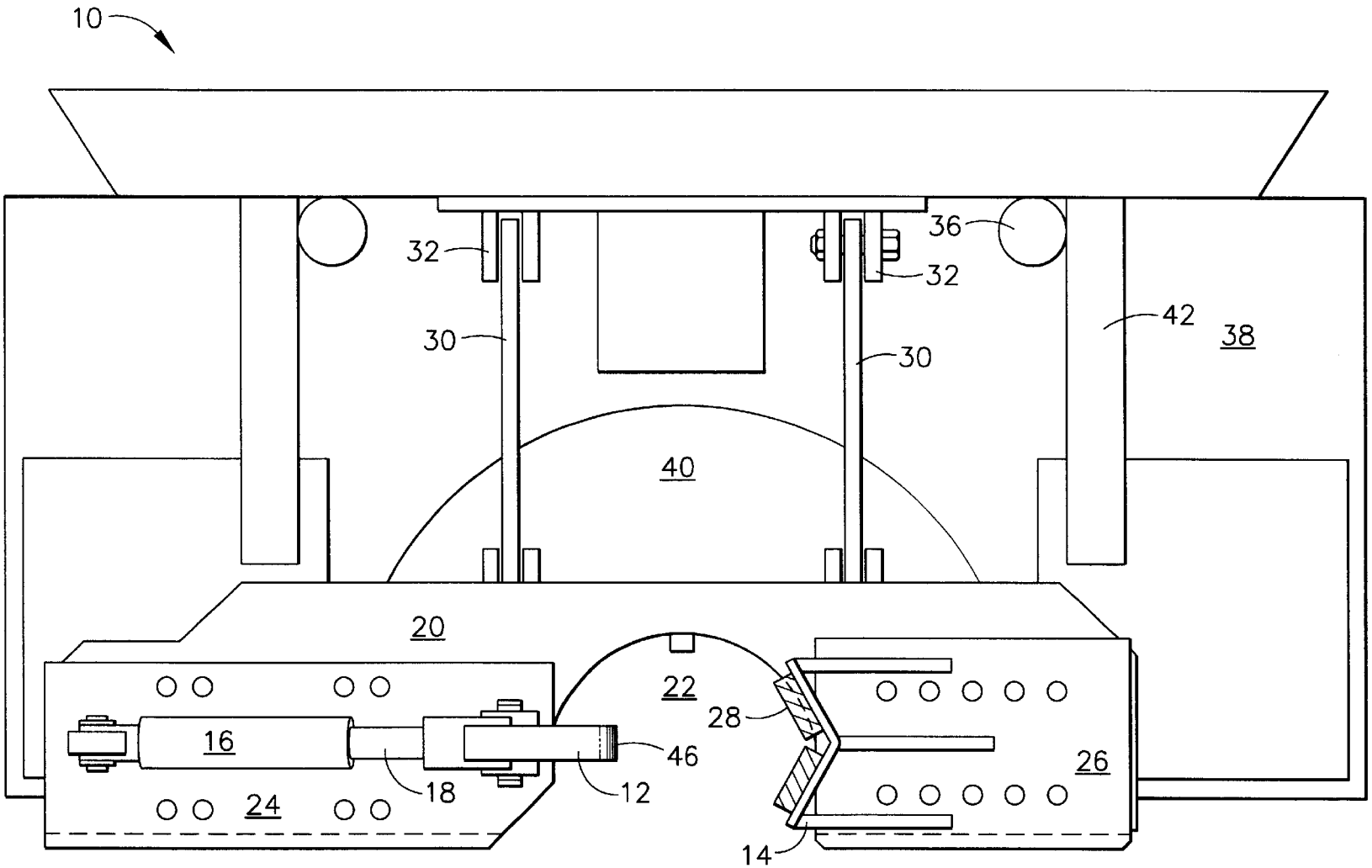
FIG. 1 is a top plan view of the post puller of the present invention.
Figure 2:
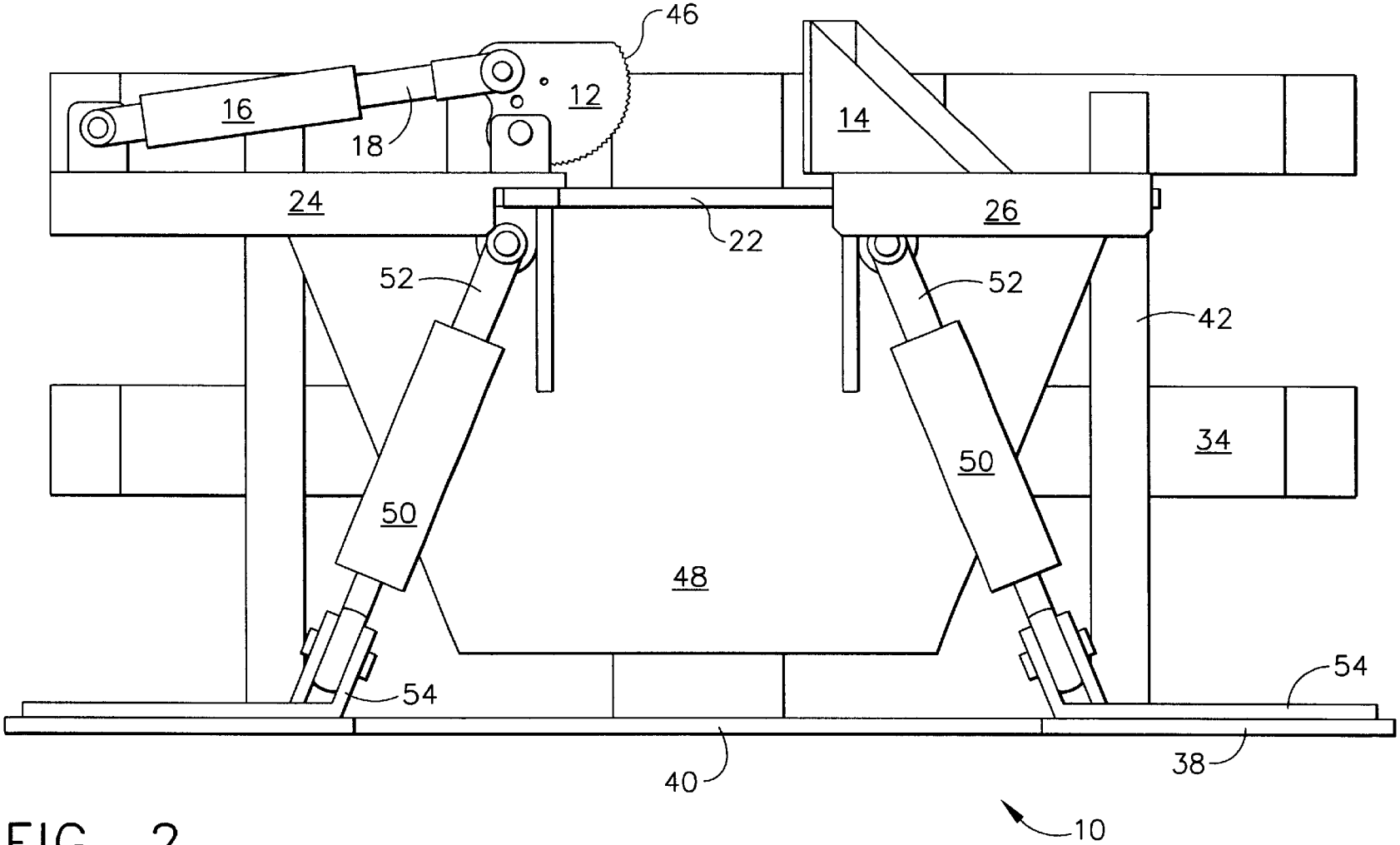
FIG. 2 is a front plan view of the post puller of the present invention.
Figure 3:
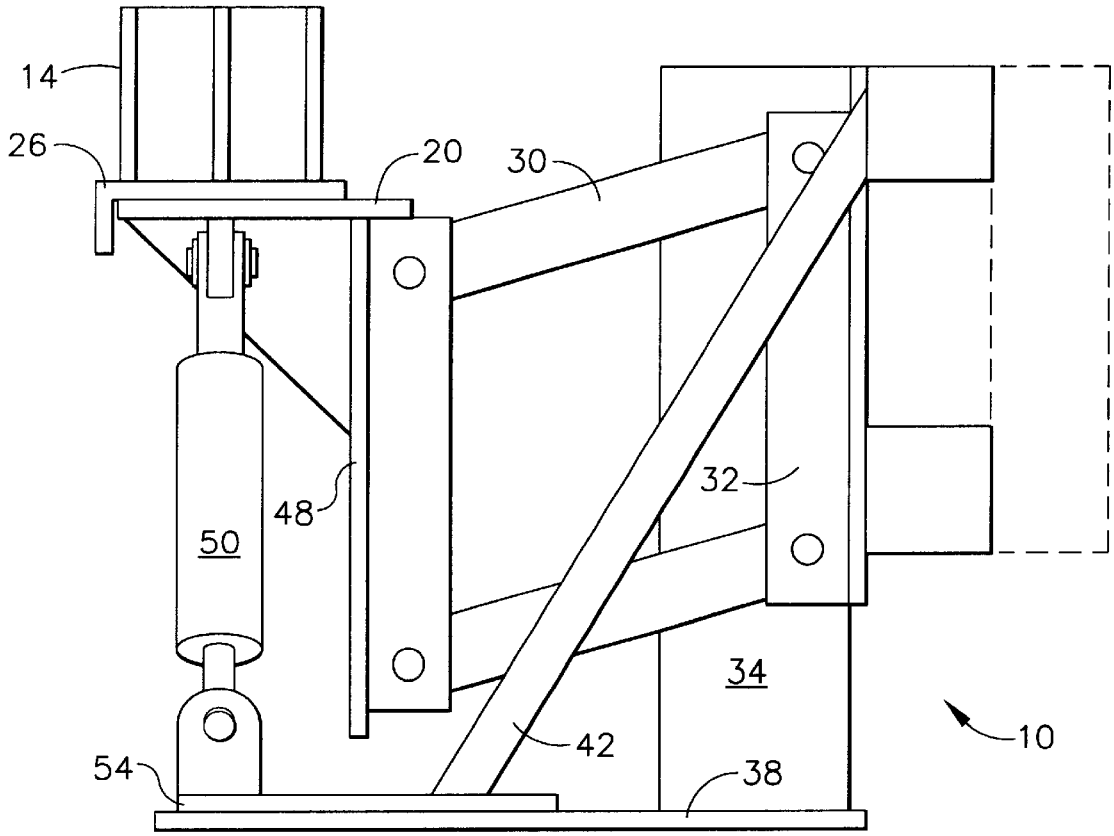
FIG. 3 is a side plan view of the post puller of the present invention.

With reference to FIGS. 1–3, the improved hydraulically operated post pulling apparatus of the present invention is indicated generally by reference numeral 10. It should be appreciated that the post pulling apparatus of the present invention is adapted to be mounted on a vehicle, such as a small tractor, skid steer mover, bulldozer, or other similar equipment. As best shown in FIGS. 2 and 3, the post pulling apparatus 10 of the present invention includes a support frame 34 that is adapted to be mounted on the skid steer mover or other vehicle. The support frame may be constructed of any suitable material and may consist of square or box tubing or of any other suitable structural elements. The support frame 34 also includes at least one, and preferably two, support brackets 42 that are disposed diagonally and that connect a base member portion 38 to the support frame 34. The base member 38 further includes a post receiving recess 40 that is adapted to essentially receive and straddle a post 44 to be engaged, secured, and removed from the ground by the post pulling apparatus 10.

According to an important aspect of the present invention, the post pulling apparatus 10 further includes a top support plate 20. As best shown in FIG. 1, top support plate 20 includes a post receiving indent 22 that is adapted to receive and straddle the post to be removed from the ground from one or more sides of the post. This arrangement differs from that of many prior art devices in that posts are typically engaged from the top requiring additional space for equipment operation and leverage to extract the post. As seen in FIG. 1, the post receiving recess 40 of the base member 38 is preferably disposed substantially underneath and is aligned with the post receiving indent 22 of the top plate 20 so as to facilitate engagement of post 44.

Figure 4:
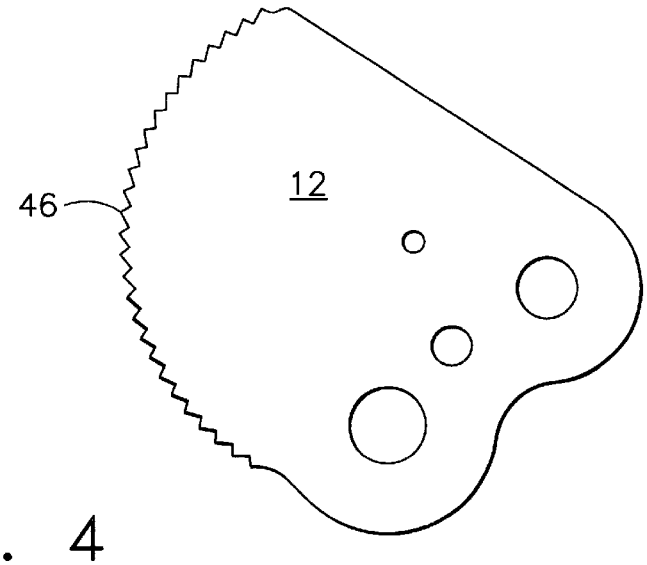
FIG. 4 is a side plan view of the rotating jaw component of the present invention.

As best shown in FIGS. 1, 2, and 4, the post pulling apparatus 10 of the present invention includes a rotating jaw member 12 that is pivotally mounted in close proximity with the post receiving indent 22 of the top support plate 20. The rotating jaw member 12 may be mounted directly on the top support plate 20 or may be mounted on a separate rotating jaw member mounting plate 24, which is, in turn, mounted on top support plate 20. The rotating jaw member 12 includes a post engaging surface 46. Post engaging surface 46 of the rotating jaw member 12 preferably is comprised of a plurality of post engaging teeth as shown in FIG. 4.

Clamping hydraulic cylinder means 16 are mounted in alignment with the rotating jaw member 12 and on top support plate 20 or the rotating jaw member mounting plate 24. The clamping hydraulic cylinder means 16 includes a piston 18 that is displaceable along a longitudinal axis. This piston 18 is pivotally attached to and partially straddles the rotating jaw member 12. When extended, the piston is advantageously adapted to rotate the rotating jaw member 12 downwardly by and into engagement with a post 44 to be removed from the ground.

A fixed jaw member 14 is provided and is mounted either directly on top support plate 20 or on fixed jaw mounting plate 26, which is, in turn, mounted directly on top support plate 20. Preferably, the fixed jaw member is substantially V-shaped and includes one or more preferably replaceable post engaging faces 28. Post engaging faces 28 are adapted to engage and receive the post 44 in conjunction with the rotating jaw member 12. Preferably, the fixed jaw component 14 is disposed and attached substantially adjacent with the post receiving indent 22 of the top support plate 20. More preferably, the fixed jaw 14 is disposed opposite the rotating jaw member 12.

In order to facilitate vertical lift of the top support plate 20, the post puller apparatus 10 of the present invention includes one or more bar links 30. Preferably, the post pulling apparatus 10 includes first and second pairs of bar links 30. As best shown in FIGS. 1 and 3, each of the bar links 30 is pivotally mounted at a first end to the support frame 34 and are further pivotally mounted at second end to a forward panel component 48. Preferably, forward panel 48 is attached to top support plate 20 substantially at an angle of 90°.

The post puller apparatus 10 of the present invention, as best shown in FIGS. 2 and 3, further comprises one or more pulling hydraulic cylinder means. Preferably, the post pulling apparatus 10 includes first and second pulling hydraulic cylinder means 50. The first and second pulling hydraulic cylinder means are each preferably mounted on a mounting brace 54 at an angle to base member 38. Each of the pulling hydraulic cylinder means 50 include a piston 52 displaceable along a longitudinal axis. Each of these pistons 52 is attached to the top support plate 20. Preferably, each of these pistons 52 is attached to the underside of the top support plate 20. When extended, the piston 52 of the first and second pulling hydraulic cylinder means 50 are adapted to raise the top support plate 20.

In general, to operate the improved post pulling apparatus 10 of the present invention, the vehicle on which the post pulling apparatus 10 is mounted is driven up to the post 44 to be removed from the ground. The driver of the vehicle aligns the post 44 in the post receiving indent of the top support plate 22 and the post receiving recess 40 of the base member 38. Preferably, the post 44 is either placed in contact with the fixed jaw post engaging faces 28 or is aligned substantially therewith. After the post 44 is in alignment, hydraulic power is activated that powers clamping hydraulic cylinder 16, which, in turn, causes clamping hydraulic cylinder piston 18 to extend. Accordingly, the extension of this piston 18 causes the rotating jaw member 12 to rotate forwardly and downwardly such that the post engaging surface 46 of the rotating jaw member 12 engages the post 44 and drives into the fixed jaw engaging face 28 of the fixed jaw unit 14. Accordingly, the post 44 to be removed is now securely clamped between the rotating jaw member 12 and fixed jaw 14.

Figure 5:
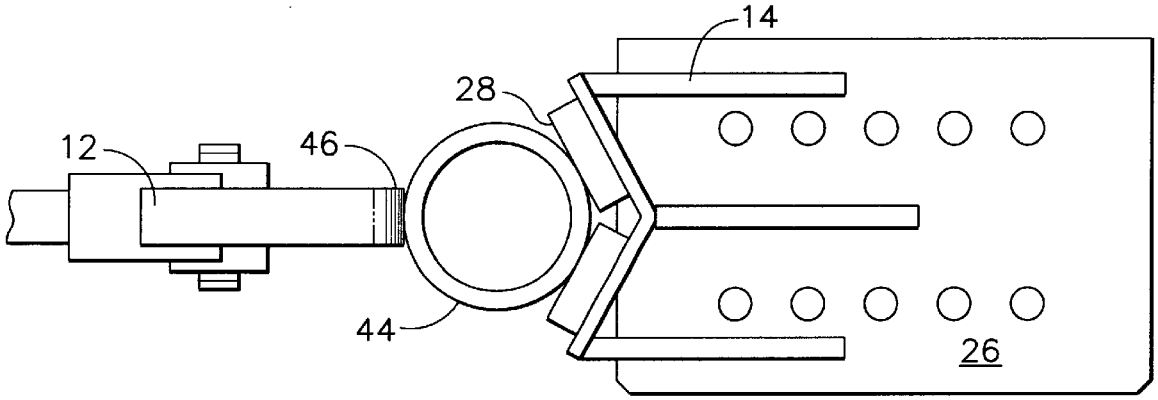
FIG. 5 is a top plan sectional view showing the fixed jaw and rotating jaw of the present invention engaging a round post.

In order to remove the post from the ground, hydraulic power is directed to pulling hydraulic cylinders 50. Preferably, a flow divider valve (not shown) is used to split the flow of oil substantially equally between the two pulling hydraulic cylinders 50. When the pulling hydraulic cylinder pistons 52 are extended, the base member 38 is caused to exert force upon the ground, since the post 44 is engaged between the rotating jaw member and the fixed jaw member 14. With continued pressure, the top support plate 20 and all of the components mounted thereon are caused to upwardly raise and are pivoted upwardly by the four bar links 30. As a result, the post or other device to be removed from the ground is broken free and lifted from the ground and may be moved and carried to a desired location. Once loose from the ground, the post secured on the post puller can be raised out of the post hole by lifting the rotor arms of the steer skid loader or other vehicle and carried to a desired location. (See FIG. 5).

It should be appreciated the configuration of the post pulling assembly 10 of the present invention is adapted to receive and extract post sizes that are essentially of any commonly used configuration. Preferably, the rotating jaw member and fixed jaw members are adjustable to secure and grip posts from one inch to eight inches in diameter. The rotating jaw member 12 and fixed jaw member 14 are configured to accommodate posts of essentially any shape or cross section, such as round posts (See FIG. 5) or posts having a square cross section. Posts of any construction, such as wood or steel posts, are able to be gripped and extricated by the post pulling apparatus of the present invention.

Although the components of the post pulling apparatus of the present invention may be comprised of essentially any suitable durable material, preferably the various components are made of hardened tool steel. Preferably, the rotating jaw member and fixed jaw members are pinned for easy adjustment and replacement when necessary.

Because the post is accepted into the post puller from the front, as opposed to loading the entire unit over the top of the post, posts may even be removed and replaced while leaving an existing fence intact. In addition, the configuration of the post receiving recess 40 of the base member 38 allows the post puller device 10 of the present invention to straddle not only the post 44 but any concrete or other setting means that supports the post. Accordingly, post support material is easily removed without interference from the base member 38 during extraction of the post.

Figure 6:
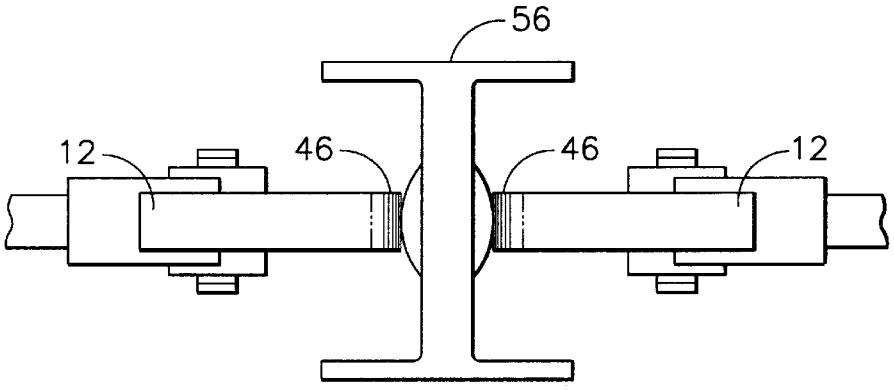
FIG. 6 is a top plan sectional view showing an alternate embodiment of the present invention including a pair of rotating jaws engaging a post having an I-shaped cross section.

As shown in FIG. 6, in an alternate embodiment of the present invention, the fixed jaw 14 may be replaced with a second rotating jaw member 12. This would readily facilitate pulling beams having an I-shaped or T-shaped cross section, such as those commonly used to support guard rails.

The foregoing description of a preferred embodiment of the invention has been presented for the purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. A hydraulically operated post-pulling apparatus adapted to be mounted on a vehicle comprising:

a) a support frame adapted to be mounted on said vehicle, said support frame comprising one or more base member brackets;

b) a base member attached to said support frame, said base member comprising a post receiving recess, said post receiving recess of said base member adapted to receive a post from one or more sides of said post;

c) a top support plate comprising a post receiving indent, said post receiving indent of said top support plate adapted to receive said post from one or more sides of said post;

d) a rotating jaw member pivotally mounted on said top support plate, said rotating jaw member comprising a post engaging surface, said rotating jaw member being mounted proximate to said post receiving indent;

e) at least one fixed jaw member mounted on said top support plate, said fixed jaw member comprising one or more post engaging faces;

f) clamping hydraulic cylinder means mounted to said top support plate, said clamping hydraulic cylinder means comprising a piston displaceable along a longitudinal axis, said piston of said clamping hydraulic cylinder means adapted to be pivotally attached to said rotating jaw member, said piston of said clamping hydraulic cylinder means being further adapted to pivot said rotating jaw member into engagement with said post;

g) one or more bar links, each of said bar links being pivotally mounted at a first end to said support frame, each of said bar links further being pivotally mounted at a second end to a forward panel, said forward panel being attached to said top support plate; and h) first and second pulling hydraulic cylinder means mounted on said base member, each of said first and second pulling hydraulic cylinder means comprising a piston displaceable along a longitudinal axis, each piston of said pulling hydraulic cylinder means being attached to said top support plate, said pistons of said first and second pulling hydraulic cylinder means being further adapted to raise said top support plate.

2. The post-pulling apparatus of claim 1 wherein said support frame is comprised of box tubing.

3. The post-pulling apparatus of claim 2 wherein said support frame further comprises first and second support brackets that connect said base member with said support frame.

4. The post-pulling apparatus of claim 1 wherein said post receiving recess is disposed substantially underneath and aligned with said post receiving indent.

5. The post-pulling apparatus of claim 1 wherein said rotating jaw member further comprises a plurality of post engaging teeth.

6. The post-pulling apparatus of claim 5 wherein said fixed jaw member is substantially V-shaped.

7. The post-pulling apparatus of claim 6 wherein said fixed jaw member is disposed opposite said rotating jaw member.

8. The post-pulling apparatus of claim 7 wherein said one or more bar links comprises first and second pairs of bar links.

9. The post-pulling apparatus of claim 8 wherein said forward panel is attached to said top support plate substantially at an angle of approximately 90°.

10. The post-pulling apparatus of claim 9 wherein each of said first and second hydraulic cylinder means is mounted on an angled mounting brace, each of said angled mounting braces being mounted on said base member.

* * * * *